US005672125A

United States Patent [19]

Ross

[11] Patent Number: 5,672,125

[45] Date of Patent: Sep. 30, 1997

[54] FLAT-FOLDING PITCHER'S PRACTICE CAGE

[76] Inventor: Charles Edward Ross, 2414 Lakeside Dr., Centralia, Ill. 62801

[21] Appl. No.: 527,934

[22] Filed: Sep. 14, 1995

[51] Int. Cl.[6] ..... A63B 69/40

[52] U.S. Cl. ..... 473/421

[58] Field of Search ..... 273/26 A, 181 F, 273/181 G, 181 J, 181 K, 127 B, 127 C; 473/421

[56] References Cited

U.S. PATENT DOCUMENTS

| | | | |
|---|---|---|---|
| 1,567,384 | 12/1925 | Rectenwald et al. . | |
| 1,923,297 | 8/1933 | Cooper | 273/26 A |
| 2,923,547 | 2/1960 | Heeremans | 273/26 A |
| 2,988,360 | 6/1961 | Lambiotte | 273/26 A |
| 3,222,067 | 12/1965 | Litwhiler | 273/26 A |
| 4,210,326 | 7/1980 | Booth et al. | 273/26 |
| 5,370,386 | 12/1994 | Parks | 273/26 |

*Primary Examiner*—Theatrice Brown
*Attorney, Agent, or Firm*—John S. Beulick

[57] ABSTRACT

A pitcher's practice cage consists of a compactly-foldable fabric-covered tubular structure which provides a large ball-gathering area, within which hangs a target marked with areas whose striking "calls" the pitch, and a ball-collecting sloping back wall and floor which accumulates pitched balls. Bows which support the canvas cover, one bow rigidly-mounted on short left-and-right support members hinge-mounted closely adjacent to the bow so rigidly supported, permit the entire structure to be folded into a flat "package" for moving and storing.

11 Claims, 3 Drawing Sheets

FLAT-FOLDING PITCHER'S PRACTICE CAGE

BACKGROUND OF THE INVENTION

1. Field of the Invention

This invention relates both to flat-folding enclosures of tubing-supported fabric and particularly to baseball pitcher's practice devices.

In its preferred form, an open-front fabric enclosure within and supported by a folding steel-tubing frame provides a large ball gathering area. In the enclosure hangs a pitcher's target marked with separate areas; the area which it strikes "calls" each pitch. The relatively large structure is foldable to a very thin "package" which is easily erected and stowed by one person.

2. Description of Related Art

While there are many patents on practice devices for improving pitching skills, and surely a number of unpatented devices have been tried out, there appear to be no established criteria for such devices.

A 1925 patent to Rectenwald U.S. Pat. No. 1,567,384 shows a platform which may be rolled; on it are a pair of permanently-erected spaced-apart vertical side members with horizontal hinges aligned at mid-height; on these hinges is mounted a tiltable slab target, which may be secured at any chosen tilt angle. The slab is hard; it causes "a swift return of a pitched ball"; and adjustment of the tilt angle causes the pitched balls to rebound to the pitcher either as ground balls or fly balls. It affords to the pitcher more fielding practice than pitching practice.

The device of U.S. Pat. No. 4,210,326 issued in 1980 to Booth shows entirely different criteria; it is a triangulated structure including a ground-level frame and a near-vertical rectangular pipe frame along whose edges are a horizontally-slidable panel and a vertically-slidable panel whose positions are adjustable to provide a variable-sized target opening. Those balls which pass through the target opening drop "dead" when they strike netting supported by a sloping rear frame.

Still other design criteria are found in the extremely complicated device shown in U.S. Pat. No. 5,370,386 to Parks. This also utilizes openings as targets which "eliminate concern from the player of being hit by a rebounded projectile" (Abstract, line 6).

SUMMARY OF THE INVENTION

In contrast to such prior art, the present device affords a foldable steel-frame outer structure which when erected opens up an open-front pitch-receiving fabric enclosure in which hangs a realistic target, divided into areas which identify each type of pitch to be practiced. The open-front area of this folding frame and fabric enclosure within it is large enough to receive even balls thrown wildly; it retains them until a dozen or so have been pitched, to permit while the pitcher to practice without interruption.

The hanging target is marked off with "high" and "low" "strike" and "ball" etc. target areas. The lower margin of the area through which pitched balls pass—even thou pitched wildly—is a cross-tube which supports a hanging "floor" for the pitching compartment; this collects the balls pitched so that the pitcher may make a dozen or so pitches without interruption.

Flat folding of the externally-supported fabric structure is accomplished by inverted U-shaped bows mounted on a pair of short fore-and-aft ground-level members. One bow is permanently erected substantially perpendicular to the ground-level members; the other bows are hinge-mounted closely adjacent to the permanently-erected bow and to each other; when opened and spread at angles from the permanently erected bow, they provide shape and a support framework about the fabric-covered structure. When folded together, the assembly is hardly more than a foot thick.

Ground-level wheels or skids, which project slightly forward from the two spaced-apart short ground level members, are utilized when the assembly is folded; tilting forwardly on these members affords easy moving by one person.

With a relatively minor structural change, the assembly is suited for an entirely different use—as a small shelter, quickly erected and folded away, to serve for example as a picnic information booth. For this purpose, there is no above-ground cross-tube nor a ball-receiving floor supported by it; instead a ground-level tube connects the two short fore-and-aft ground level members; this ground-level tube serves as a skid when the assembly is folded and tilted forward for moving to and from storage.

BRIEF DESCRIPTION OF THE DRAWINGS

FIG. 5 is a view, seen from the same angle as FIG. 4, of a modification of the present invention including a hinged bow forward of the rigidly-erected bow tilted forward, and with the bottom of the framed opening shown lower to ground level, this embodiment being useful as a portable outdoor booth for use at picnics and the like.

DESCRIPTION OF THE PREFERRED EMBODIMENT

Figure 1:
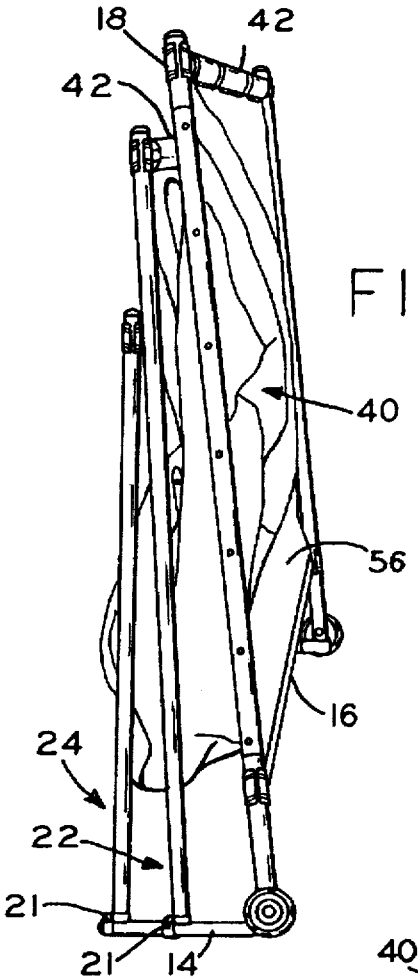
FIG. 1 is a side view, partly in perspective, showing the foldable booth structure flattened and in position for storage.

A flat-folding pitcher's practice cage embodying the present invention is shown in FIGS. 1–4 of the drawings. The construction consists of two portions to be described: a metal, preferably steel tube, outer frame structure generally designated 10, which hangs suspended within it a fabric enclosure generally designated 40. While the metal structure is here shown to be tubular, it is to be understood that it might be made in other forms, for example, T-shaped aluminum extrusions. That exterior structure comprises a fixed-position structure including short fore-and-aft extending base members 14 spaced apart parallel to each other, and held in position by a lower spacing member 16 which in FIGS. 1–4 is above ground level, serving as a reinforcement member of a first inverted U-shaped bow 18 whose lower ends 20 are welded adjacent to the forward ends of the spaced-apart base members 14. Thus, the base members 14 together with the inverted forward bow 18 reinforced by its lower cross-member 16 serve as the fixed structure of the present invention. The inverted bow 18 is shown as made up of two vertical members and an upper cross-member as well;

the subsequent bows hereinafter described are made up similarly, except hinged to the base member 14 for folding rearwardly out of perpendicular, as permitted by the aft-folding hinges 21, which support both an intermediate inverted bow 22 on the base members 14 and an aft hinged bow 24, spaced a short distance from each other successively aft of the fixed inverted U-shaped bow 18. For clarity in illustration, the spacings between the points of affixation are shown somewhat enlarged on FIGS. 1–4. The total length of the base members 14 need be not substantially greater than about a foot. At the front ends of the base members 14 is mounted a pair of wheels 30 rotating about axes elevated slightly above the upper surface of the base members 14 so that the lowermost extent of the wheels 30 is about at ground level. When the assembly is in the FIG. 1 position and tilted forward, it may be readily rolled to a storage position.

Figure 2:
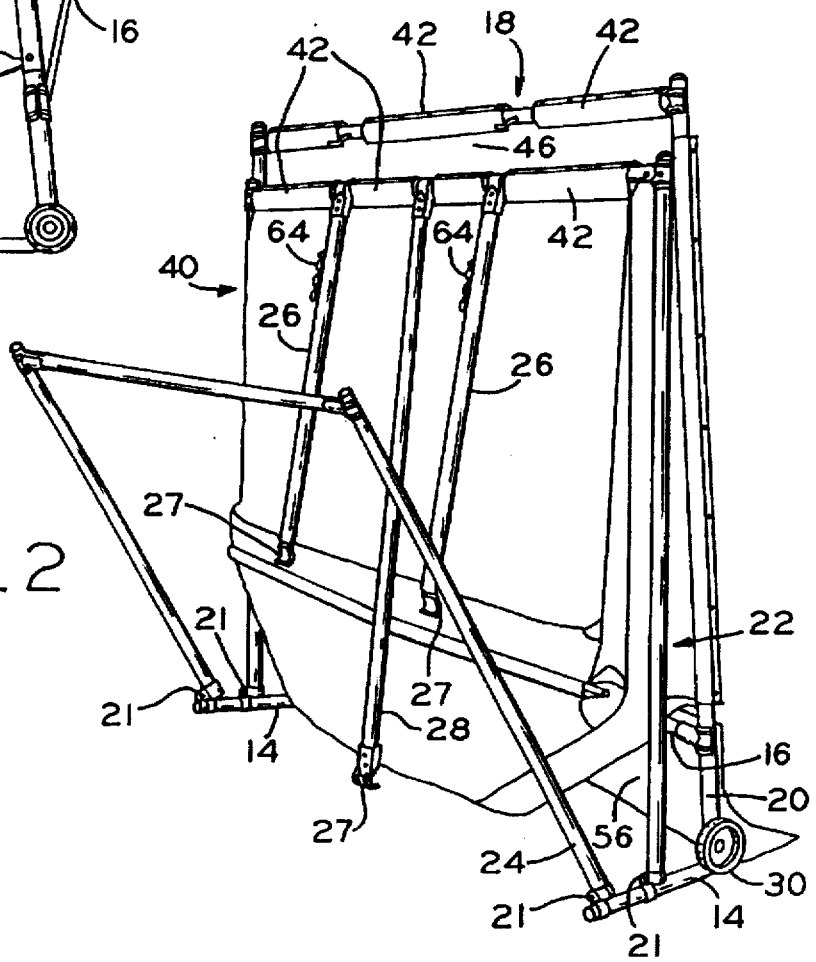
FIG. 2 shows the booth structure with its pivotal rear bow partly folded downward, the intermediate bow being shown in the same position as in FIG. 1.
Figure 3:
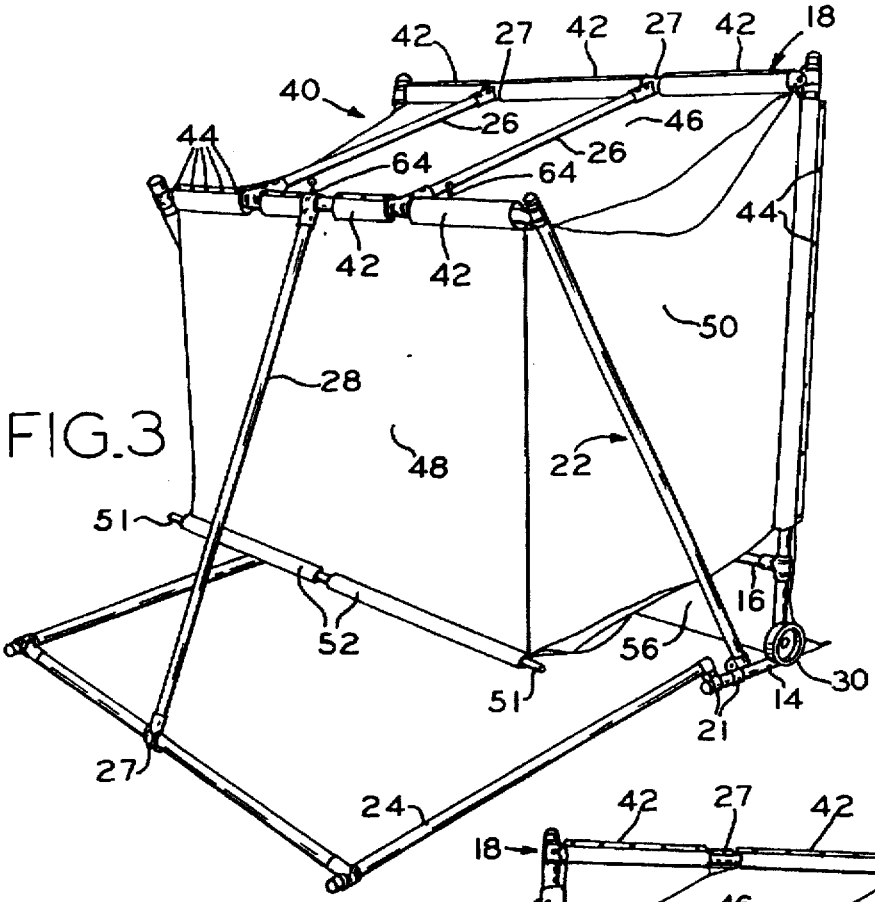
FIG. 3 shows the rear bow folded down to ground level, the intermediate bow folded through an angle roughly 30°, and intermediate struts in place between the respective inverted bows, suspending the fabric structure in final position as shown partly from the rear and partly from one side.

Referring to FIGS. 2 and 3, there are supported on the upper cross-member of the intermediate bow 22 a pair of shorter separator rods 26, hinged thereto and adapted to be swung forwardly to grasp the upper cross-member of the forward-fixed bow 18, and with a longer separator rod 28 having an end 27 adapted to reach backward and downward as in FIG. 3 to grasp at its mid-point the uppermost member of the bow 24 when rotated backward to ground position as shown in FIG. 3. This completes the metal framework within which the open-front fabric assembly is suspended.

Figure 4:
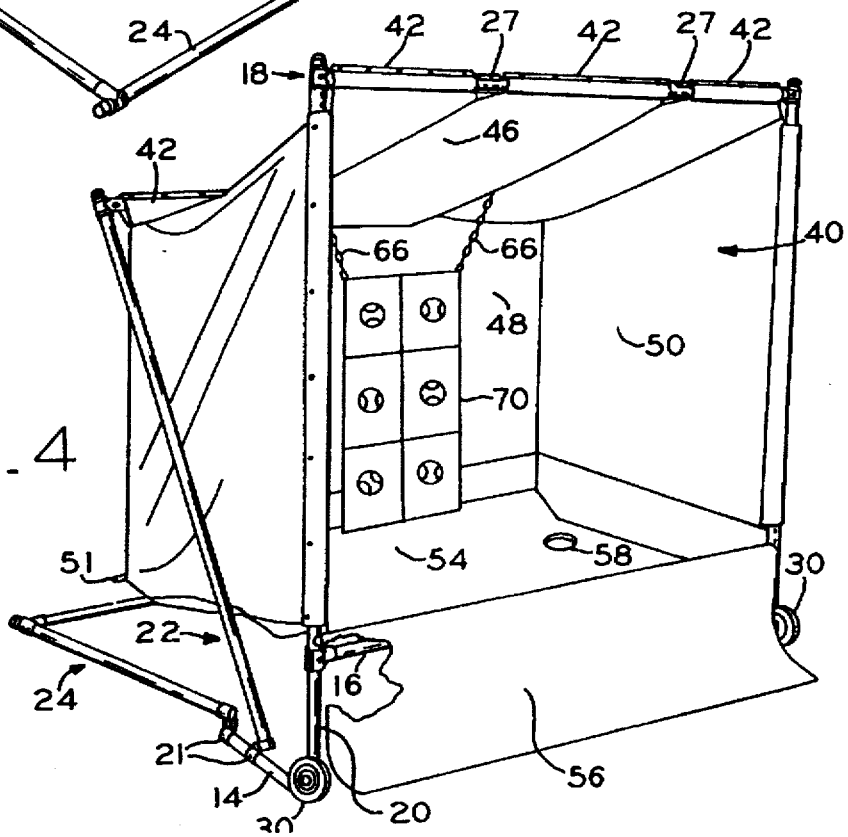
FIG. 4 is a three-quarter front view showing the parts in the same position as in FIG. 3 and with a target hanging within the interior.

The fabric enclosure, generally designated 40, is best seen in FIGS. 3 and 4. It is an open front enclosure, having outwardly-extending overlapping flaps 42 at its upper forward, upper rear, and lower forward extremities which are used to assemble it to the corresponding members of the framework, as shown in FIGS. 2, 3 and 4, the flaps being drawn about the steel tubing members, overlapped, and secured in overlapping position by screws 44, shown in FIGS. 2, 3 and 4 (the lower overlapping flaps, which are screwed onto the lower spacing tube 16 of the front inverted bow 18 being omitted for clarity of illustration). These overlapping flaps are provided at the forward edges of the top wall 46, rear wall 48, and side walls 50, at the forward bow 18, and also a set of such overlapping flaps is provided at the upper rear corner of the fabric enclosure 40. In case of need to renew the fabric enclosure 40, removal of these screws from the practice cage to repair or renew the fabric enclosure 40, the overlapping flaps affixed by screws make this possible.

At the intersection of the rear wall 48 of the fabric enclosure 40, with a bottom wall 54 therefor, a slender external sleeve 52 of fabric is provided; in this horizontally-extending sleeve is inserted a rod 51 which serves not only to maintain a straight juncture, but also to provide enough weight to keep it hanging in alignment.

A flexible bottom wall 54 is provided, having a certain "droop" so that it leads upwardly to securement to the horizontal spacing member 16, and may extend thereover to provide an outward draped shield portion 46 which, when in position shown in FIGS. 2, 3 and 4, prevents balls which may be pitched too low to be received within the open front of the fabric enclosure 40, will not roll thereunder which would make retrieval difficult. Within the enclosure, the bottom wall is preferably hung at a slant to the right side as shown in FIG. 4, where the ball drain opening 58 may be provided; under it a basket may be placed to catch the pitched balls which pass through the forward opening of the enclosure and drop downward therein.

Within the enclosure, a target 70 is hung, with a number of areas marked off to striking by a ball, indicating the strike zone, whether the ball is high or low, etc. The target 70 is shown hanging from chains 66, which extend upward through the top wall 46 of the fabric enclosure where they may be hooked onto short lengths of chain 64 hanging from the upper separator rods 26 when erected forwardly as shown in FIG. 3. This hanging system relieves the fabric top wall 46 from the successive shocks which would otherwise be imposed by pitched balls striking the target 46.

Figure 5:
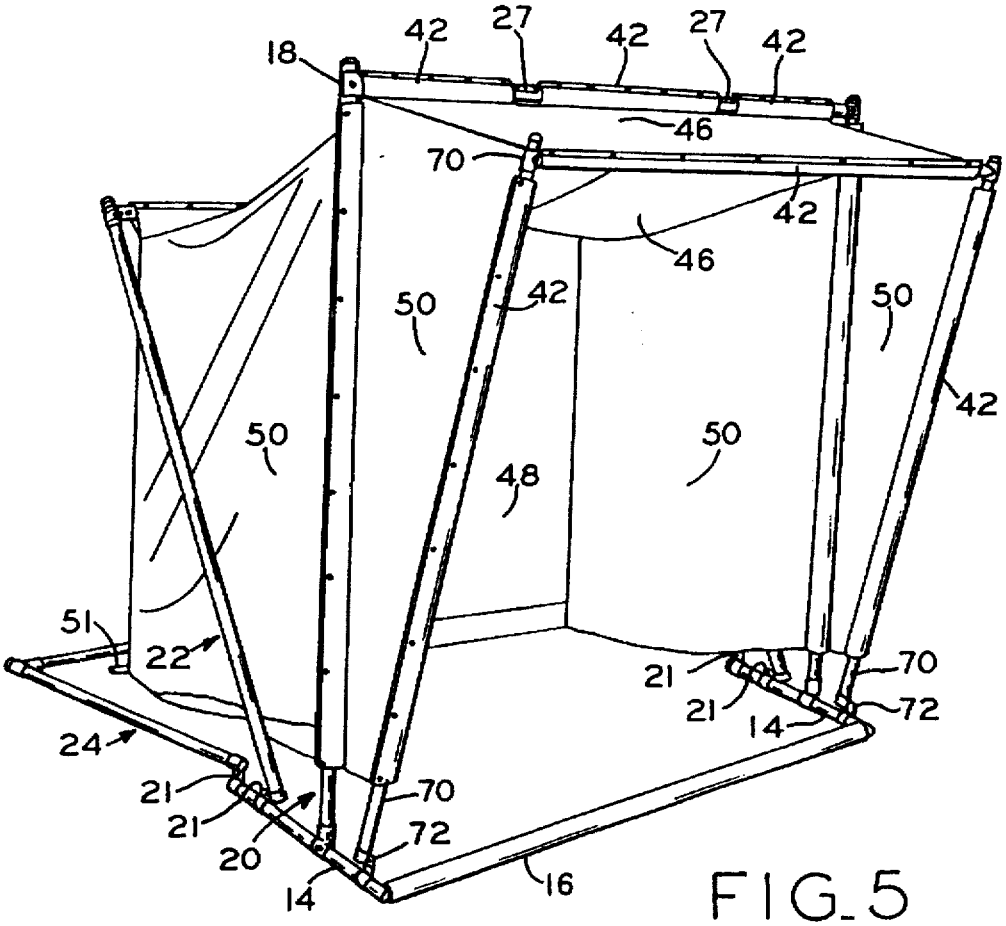

Referring now to FIG. 5, this embodiment of invention is suited for use, not for pitching practice, but as a portable foldable booth, temporarily erected for such purposes as picnics or other outdoor events. Here spaced-apart base members 14' are slightly longer than those of FIGS. 1–4 to accommodate an additional hinged bow, this one hinged to tilt forwardly away from the fixed position bow 20 (to avoid confusion, the same figures are used in the following description where parts here utilized are identical with those of the previously-described embodiment). At the foremost end of the somewhat longer base member 14, a ground level spacing member 16' is provided; this serves (in the absence of an elevated tube 16) to reinforce the steel structure. Between the extended-forward ends of the base members 14 are mounted hinges, rotatable in the opposite sense from the aft-folding hinges 21 of the previous embodiment, to carry a forward tiltable bow 70, otherwise similar to the intermediate bow 22, but movable through a smaller angle, as permitted by side wall portions 50' and a top wall portion 46', which are extensions of the fabric enclosure. Otherwise, the fabric enclosure is the same as described in the preceding embodiment, except it extends all the way to ground level and has no floor.

With the slightly greater length of the base members 14', this embodiment is nevertheless foldable nearly as flat; and since the ground level spacing member is preferably the tube 16' illustrated it serves as a skid when the folded structure is tilted forward. The additional structure and fabric forward of the erected bow 18 affords protection as from sun and wind, effectively enlarging the usable space within the enclosure.

As used herein the term "enclosure" specifically includes those which are open at front, and some of which may be open at bottom.

As various modifications may be made in the constructions herein described and illustrated without departing from the scope of the invention, it is intended that all matter contained in the foregoing description or shown in the accompanying drawings shall be taken as illustrative rather than limiting.

I claim:

1. A pitcher's practice cage comprising:

a fabric enclosure including at least top, side and rear walls, external fixed-position structure including a pair of longitudinal spaced-apart base members and one inverted U-shaped member having its lower ends rigidly-mounted on and substantially perpendicular to said base members, external folding-structure including at least one inverted U-shaped member having its lower ends mounted hingedly on said base members at one side of said rigidly-mounted member, said folding structure positionable angularly in a range from a first position wherein said hinge-mounted U-shaped member is close and parallel to said rigidly-mounted member to a second position wherein said hinge-mounted U-shaped member is angularly spaced from said rigidly-mounted member, means to secure forward edges of said fabric enclosure to said rigidly-mounted member and to suspend said rear wall of said enclosure from at least one said hinge-mounted U-shaped member, whereby when said hinge-mounted U-shaped member is positioned at said first position, said fabric enclosure and said rigidly-mounted member and said hinge-mounted U-shaped member structure constitute a substantially flat, readily-stored assembly, and when said hinge mounted U-shaped member is positioned at said second position, said fabric enclosure further comprises an open front.

2. A pitcher's practice cage in accordance with claim 1, wherein said fabric enclosure top wall extends to, and said enclosure rear wall is suspended from, said hinge-mounted U-shaped member adjacent to said rigidly mounted member.

3. A pitcher's practice cage in accordance with claim 2, wherein said fabric enclosure further comprises a bottom wall adjacent said rear wall, said rigidly-mounted inverted U-shaped member includes a horizontal cross-member spaced above ground-support level, said fabric rear wall extends downward below said horizontal cross-member, and said fabric bottom wall is coupled to said horizontal cross-member.

4. A pitcher's practice cage in accordance with claim 3, further comprising a baseball pitching target positioned forwardly of said fabric rear wall.

5. A pitcher's practice cage in accordance with claim 3, further comprising a pair of struts hinged to said hingedly-mounted U-shaped member adjacent to said rigidly mounted U-shaped member and releasably securable to said rigidly mounted U-shaped member, and a baseball pitching target coupled to said struts.

6. A pitcher's practice cage in accordance with claim 1, wherein said external folding structure includes at least a second inverted U-shaped member having its lower ends mounted hingedly on said base members successively away from said rigidly mounted U-shaped member, whereby when said second inverted U-shaped member is opened angularly to a position substantially perpendicular to said rigidly mounted U-shaped member, said folding structure serves as a ground support for the pitcher's practice cage.

7. A pitcher's practice cage in accordance with claim 6, further comprising a separator means securable between said successive hinge-mounted U-shaped members.

8. A pitcher's practice cage in accordance with claim 7, comprising only two hinge-mounted U-shaped members.

9. A pitcher's practice cage in accordance with claim 1, further comprising a roll means at said spaced-apart base members.

10. A pitcher's practice cage in accordance with claim 1, wherein said rigidly-mounted inverted U-shaped member comprises a horizontal spacing member extending between said lower ends thereof at ground-support level, and wherein said external folding structure further comprises an inverted U-shaped member having its lower ends mounted hingedly on said base member at an opposite side of said rigidly mounted U-shaped member.

11. A pitcher's practice cage in accordance with claim 10, wherein said horizontal spacing member comprises a tubular member.

* * * * *